United States Patent [19]

Glasoe

[11] 4,026,971

[45] May 31, 1977

[54] EVAPORATIVE COOLER

[76] Inventor: Ronald M. Glasoe, 840 Hamilton Lane, Escondido, Calif. 92025

[22] Filed: July 25, 1975

[21] Appl. No.: 599,180

[52] U.S. Cl. ..... 261/29; 98/2.11; 98/2.14; 98/2.17; 261/DIG. 4; 261/DIG. 15

[51] Int. Cl.[2] ..... B60H 1/26; F24F 7/06

[58] Field of Search ..... 261/DIG. 4, 29, 24, 261/DIG. 15

[56] References Cited

UNITED STATES PATENTS

| | | | |
|---|---|---|---|
| 2,237,497 | 4/1941 | Munford | 261/DIG. 4 |
| 2,752,134 | 6/1956 | Paulus | 261/DIG. 4 |
| 2,769,620 | 11/1956 | Davidson | 261/29 |
| 3,155,746 | 11/1964 | Banks | 261/91 |
| 3,365,181 | 1/1968 | Schwaneke | 261/91 |
| 3,372,911 | 3/1968 | Herboldsheimer | 261/24 |
| 3,552,097 | 1/1971 | Grasseler | 261/29 |
| 3,583,174 | 6/1971 | Logue | 261/DIG. 4 |
| 3,687,424 | 8/1972 | Katzman et al. | 261/DIG. 4 |

FOREIGN PATENTS OR APPLICATIONS

| | | | |
|---|---|---|---|
| 1,044,725 | 8/1958 | Germany | 261/29 |

*Primary Examiner*—Tim R. Miles
*Assistant Examiner*—Gregory N. Clements
*Attorney, Agent, or Firm*—William P. Green

[57] ABSTRACT

An evaporative cooler having an evaporation pad shaped to extend essentially circularly about a blower to define an essentially circular chamber into which the blower draws air through the pad to evaporate moisture therefrom. The chamber may have oppositely convex top and bottom walls, with the blower preferably discharging downwardly through the bottom wall. Water is fed to the top of the pad through a tube extending circularly along the upper edge of the pad and containing water under pressure and having spaced openings through which the water discharges onto the pad.

6 Claims, 10 Drawing Figures

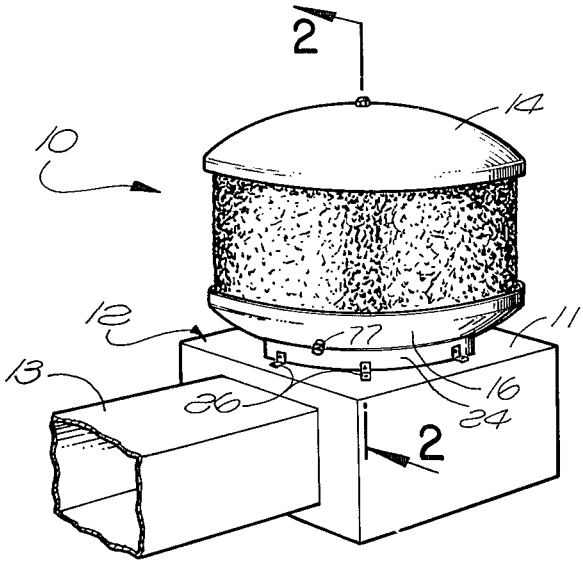
FIG. 1.
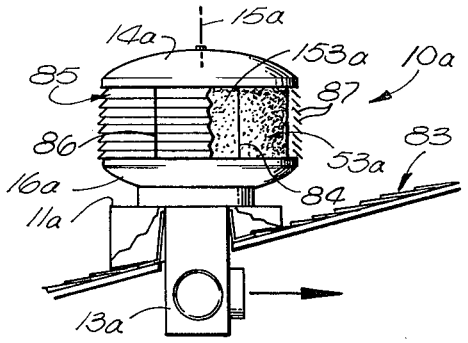
FIG. 10.
FIG. 3.
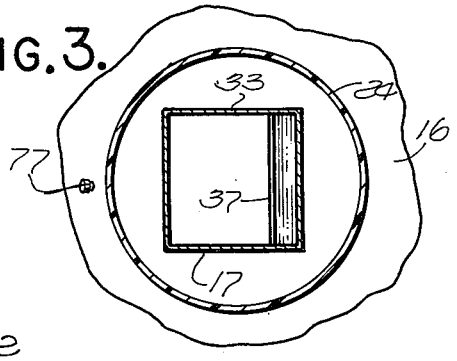
FIG. 2.
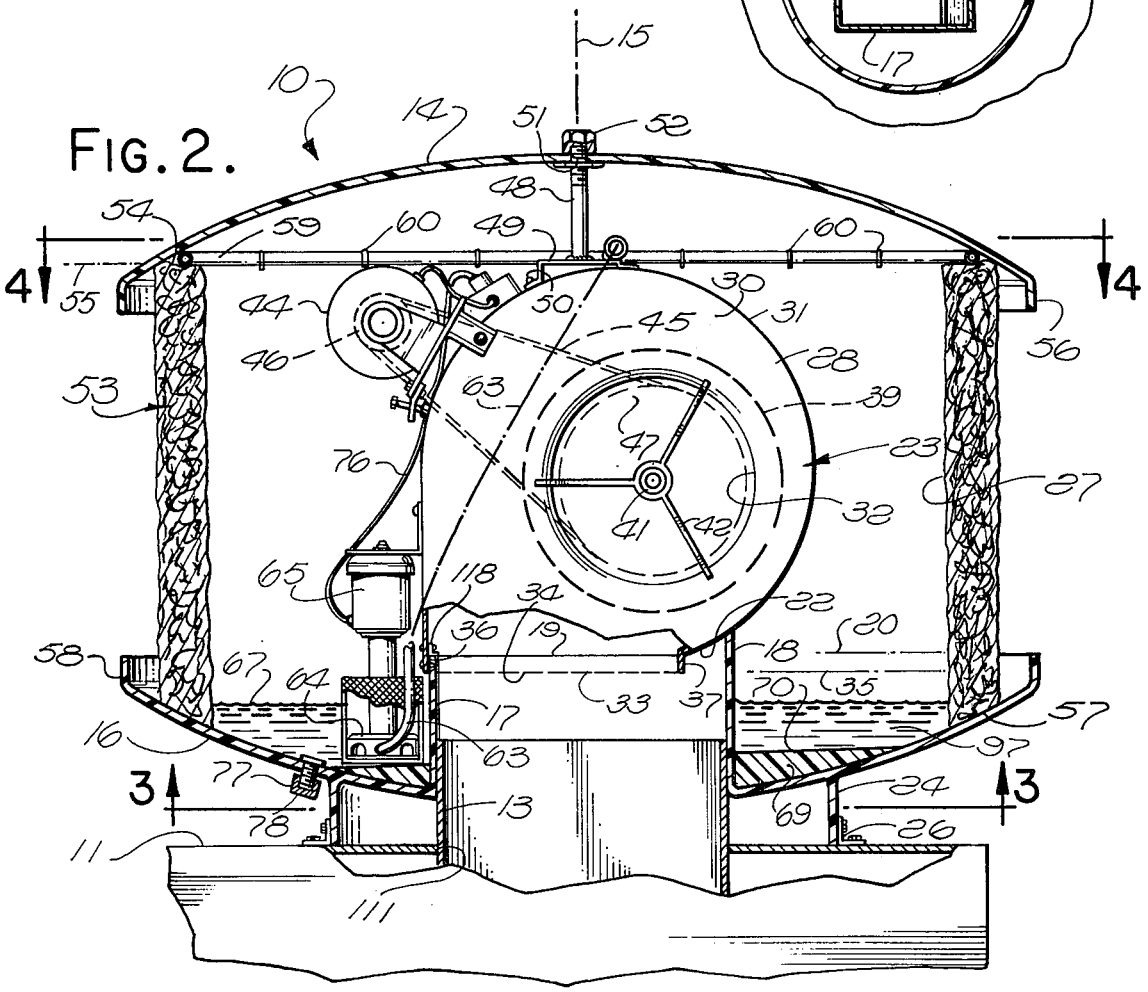

FIG. 4.
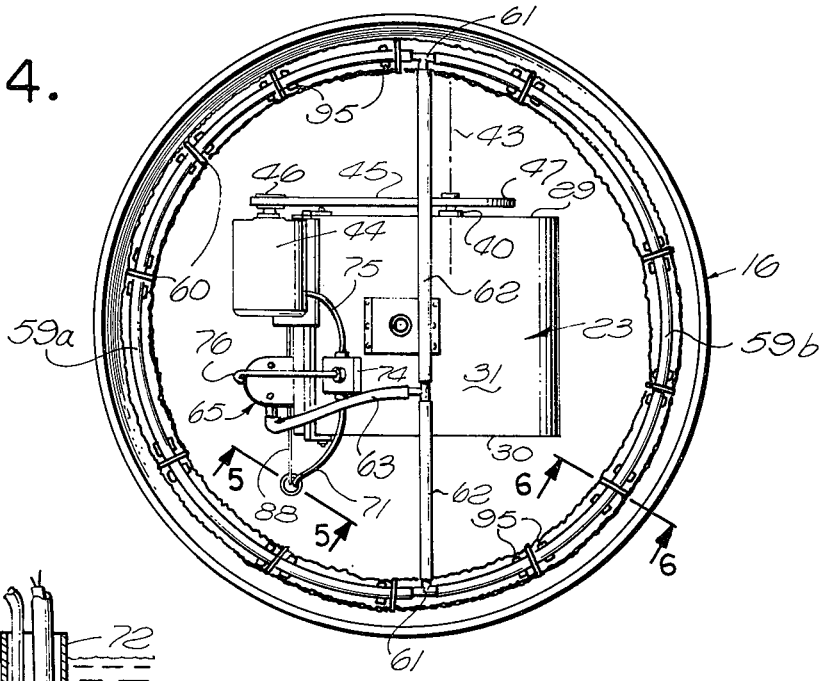
FIG. 5.
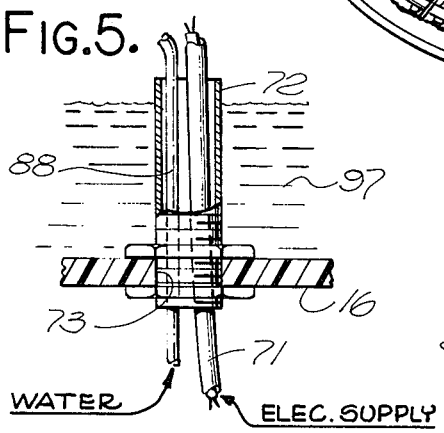
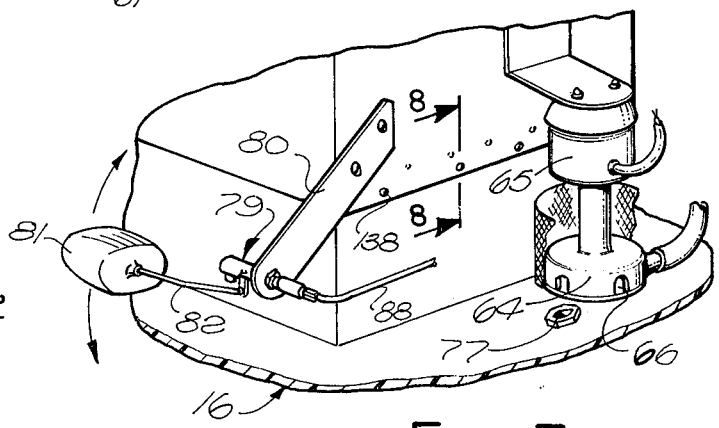
FIG. 7.
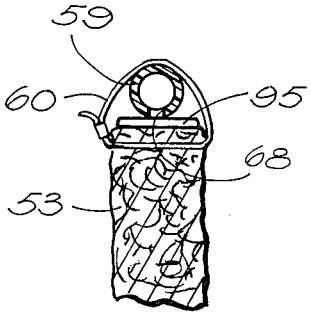
FIG. 6.
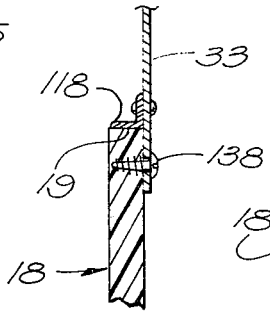
FIG. 8.
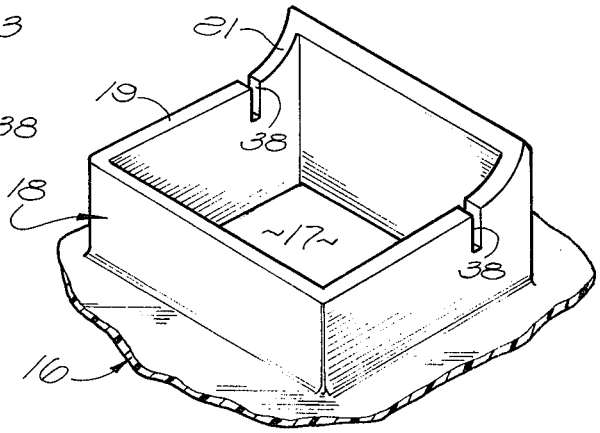
FIG. 9.

EVAPORATIVE COOLER

BACKGROUND OF THE INVENTION

This invention relates to improved evaporative coolers. In many instances in which refrigerated air conditioning is too expensive for use, or impractical for some other reason, a room or building can be cooled rather effectively by an evaporative type cooler, in which water is evaporated into the air to absorb part of its heat by the well known evaporative cooling effect. The water is usually delivered onto a pad formed of fibrous material, with a flow of air being drawn through the pad by a blower to evaporate the moisture and discharge the cooled air into the room or rooms which are to be cooled.

The conventional evaporative coolers of which I am aware are normally shaped as rectangular boxes, having a pad or pads mounted in one or more of their sides, with the blower contained within the box and drawing air through the pad. Such rectangular arrangements are relatively expensive to construct, and cumbersome to mount, and may be difficult to clean and service.

SUMMARY OF THE INVENTION

The present invention provides a unique evaporative cooler structure which may be much simpler to manufacture than the above discussed conventional rectangular box arrangement, and which may be functionally more effective in its cooling action. Structurally a cooler embodying the invention utilizes an evaporation pad structure which is curved generally circularly about the blower of the device, in a relation enabling air to be drawn through the pad structure to a chamber formed within its interior from any of different sides of the device, and preferably through the entire 360° circular extent of the pad. An extremely effective cooling action can thus be attained in a minimum of space, with very efficient use of every square inch of pad area. Disassembly and repair of the unit can be facilitated by providing the device with a circular top wall which is removable to expose the blower and other equipment within the interior of the pad for servicing. Desirably, that equipment includes a pump which takes suction from the lower portion of the inner chamber within the pad, and discharges water to the upper edge of the pad to flow downwardly therethrough.

In the prior evaporative coolers of which I am aware, water has been discharged into the upper portion of the pad through, into which the water is fed and from which the water flows by gravity. A particular feature of the present invention resides in the preferred provision of a pressurized tube which extends along the upper edge of the pad, and within which water is maintained under pressure to flow from the tube through a series of spaced openings, which, because of the pressurized condition of the water are automatically maintained in cleaner condition than where gravity flow is employed as in prior devices. The tube desirably is circular to extend along the circular upper edge of the previously discussed circular pad.

BRIEF DESCRIPTION OF THE DRAWINGS

The above and other features and objects of the invention will be better understood from the following detailed description of the typical embodiment illustrated in the accompanying drawing in which:

FIG. 1 is a perspective view of an evaporative cooler constructed in accordance with the invention;

FIG. 2 is an enlarged vertical section taken essentially on line 2—2 of FIG. 1;

FIG. 3 is a reduced horizontal section taken on line 3—3 of FIG. 2;

FIG. 4 is a view taken on line 4—4 of FIG. 2, showing the plan view appearance of the device with the cover removed;

FIGS. 5 and 6 are enlarged fragmentary vertical sections taken on lines 5—5 and 6—6 respectively of FIG. 4;

FIG. 7 is a fragmentary perspective view showing the float valve and pump of the device;

FIG. 8 is a fragmentary vertical section taken on line 8—8 of FIG. 7;

FIG. 9 is a perspective view of the blower mounting portion of the bottom wall structure; and FIG. 10 shows the manner in which the cooler may be connected into the roof of a building.

DESCRIPTION OF THE PREFERRED EMBODIMENT

Referring first to FIG. 1, there is illustrated at 10 an evaporative cooler constructed in accordance with the invention, mounted on a horizontal supporting wall or plate 11 which is typically illustrated as the top wall of a support box 12. A square duct 13 extends upwardly through an opening 111 in supporting wall 11 and delivers the cooled air to the rooms or areas to be cooled.

The cooler 10 has an upwardly convexly curved circular cover or top wall 14 which is centered about and symmetrical with respect to vertical axis 15 of the device. At its uderside, cooler 10 has a similar downwardly convex circular bottom wall 16, also centered about and symmetrical with respect to axis 15. Both of these walls are preferably formed of a rust-proof material, such as a fiberglass reinforced resinous plastic material.

Bottom wall 16 contains a central opening 17 through which cooled air passes downwardly into duct 13. About opening 17 the material of bottom wall 16 is shaped to form an upwardly projecting vertical flange 18, desirably of square cross section and fitting closely about duct 13 (see FIGS. 3 and 9), and terminating upwardly at an edge 19 which lies in a horizontal plane 20 except at one side where it curves upwardly at 21 to follow the curvature of and support the curving undersurface 22 of a blower 23.

The bottom wall 16 is rigidly secured to supporting wall 11 as by a cylindrical mounting tube 24, which may be formed integrally at its upper end with and project downwardly from bottom wall 16, and be secured rigidly to the upper side of wall 11 by a number of circularly spaced angle irons or brackets 26 screwed to wall 11 and tube 24. The tube 24 is desirably centered about the previously mentioned vertical axis 15 of the device.

Flange 18 serves to mount the blower 23 within an upper round chamber 27 formed in the interior of cooling assembly 10. This blower 23 may be a conventional centrifugal type blower, having a hollow housing 28 with two parallel vertical opposite side walls 29 and 30 and an essentially circular wall 31 extending therebetween. Air enters this blower housing through two inlet openings 32 in walls 29 and 30 communicating with chamber 27, and air leaves the blower through a lower horizontally rectangular portion 33 of the housing communicating in sealed relation with square flange 18 to deliver air thereto. Rectangular portion 33 has a bottom edge 34 lying in a horizontal plane 35 spaced beneath plane 20 of the upper edge of flange 18, and engages the outer surface of flange 18 in vertically overlapping relation (as represented at 36 in FIG. 2) along three sides of the flange (the three sides represented at the top, bottom and left side of FIG. 3). The fourth side of rectangular portion 33 of the blower housing extends across square flange 18 at 37 (FIGS. 2 and 3), being received within slits 38 in opposite sides of flange 18, so that the curved portion 22 of the blower housing may rest on and be supported by the upwardly curving portion 21 of edge 19 of flange 18 as previously discussed. At the left side of the blower as viewed in FIG. 2, the blower may be supported on flange 18 by an angle iron bracket 118 secured to the blower housing and resting on edge 19 of flange 18. Also the rectangular portion of the blower may be secured rigidly to flange 18 by a number of screws 138 extending through the engaging vertically overlapping portions of these parts.

The blower housing may contain a conventional centrifugal impeller 39, mounted by bearings 40 and 41 carried by spiders 42 within openings 32 of walls 29 and 30 to turn about a horizontal axis 43. An electric motor 44 appropriately mounted to the outside of the blower housing drives the blower impeller through a flexible belt 45 engaging pulley wheels 46 and 47 on the motor and blower respectively.

The cover 14 of the device may be removably secured in place by connection to a tubular post 48 centered about axis 15. The lower end of this post 48 may be rigidly secured to housing 28 of the blower, as by rigid attachment to a bracket 49 which is secured by screws 50 to the top of the blower housing. The upper end of post 48 extends through a central circular opening 51 in cover 14, to threadedly receive a cover retaining nut or threaded cap 52.

The sides of the circular inner chamber 27 within cooling assembly 10 are formed by a cylindrical vertical evaporation pad 53, which is centered about and extends circularly about axis 15. This pad is formed to have a large number of air passages through which air may pass horizontally inwardly from the outside of pad 53 to the inner chamber 27. In accordance with conventional practice the pad 53 is kept moist by passing water downwardly therethrough, so that some of this water can evaporate into the inwardly flowing air and cool it by evaporation. To accomplish these purposes, the pad may be formed of a large number of wood fibers arranged in random fashion to form air passages therebetween, and suitably secured together to maintain the integrity of the cylindrical pad during handling and in use. The fibers may typically be held together by cement or another binder or by an appropriate wire screen or other frame structure surrounding or supporting the fibrous material.

At its upper end, pad 53 has a circular top edge 54, lying generally within a horizontal plane 55 and adapted to engage or be received in very close proximity to the undersurface of circular cover 14, with the periphery of the cover desirably projecting laterally beyond the pad (FIG. 2), and being turned downwardly to form an annular overhanging edge 56. Similarly, the bottom circular edge 57 of the pad may annularly engage the upper surface of bottom wall 16, with the periphery of this wall extending laterally beyond the pad and forming an annular upwardly curved edge 58. The pad is thus confined between and held in position by the top and bottom walls 14 and 16, without the necessity for other pad retaining or locating elements.

Water is fed to pad 53 from a circular tube 59, which is centered about axis 15 and extends along and is supported by the upper surface 54 of the pad through a series of circularly spaced supporting elements 95 vetically between surface 54 and the tube. This tube may be held in position by cords or straps 60 extending about the tube at circularly spaced locations and extending through the pad near its upper edge. The tube 59 may be formed of two complementary semi-circular halves 59*a* and 59*b* (FIG. 4), having their ends joined together in fluid conducting relation at two diametrically opposite locations by a pair of insert "T"fitting 61, which place the interior of both halves of tube 59 in communication with a pair of flexible plastic tubes 62 connected to another tube 63 which extends downwardly to receive pressurized water from a pump 64 driven by an electric motor 65. Pump 64 has a suction opening at a level 66 near the bottom of the lowermost portion of the water retaining chamber formed within the downwardly convex bottom wall 16. Water is maintained in this bottom wall and about its flange 18 up to a level such as that represented at 67 in FIG. 2, and is pumped upwardly through line 63 and tubes 62 to tube 59 from which the water is allowed to discharge downwardly into the top of the pad through a number of circularly spaced openings 68 (See FIG. 6) formed in the bottom of tube 59 circularly between supports 95. These openings are small enough to prevent discharge of water therethrough as rapidly as pump 64 can feed water to the tube, so that the water is maintained at super-atmospheric pressure within tube 59, and is forced by that pressure through openings 68 in a manner tending to maintain those openings clean and preventing clogging such as occurs when only gravity flow is employed. Elements 95 maintain the portions of the tube 59 which contain openings 68 slightly out of contact with pad 53, to thus further assure against cloging of the openings.

The water which is not evaporated from pad 53 flows downwardly from its lower end into the body of water 97 and is recirculated by pump 64. In order to assure effective suction for the pump 64, there may be adhered to the upper side of bottom wall 16, at a location about its upstanding flange 18, a layer of material 69 (FIG. 2), which may be thinnest at the location of the suction opening 64, and gradually increase in thickness to a diametrically opposite location 70, to thereby form a sloping bottom wall of the water chamber having its lowermost portion at pump 64 and assuring flow of all water thereto. This layer of material 69 may be typically formed of tar, fiberglass bead or filler material, light concrete, or other appropriate water resistant material.

Electricity may be supplied to the device through a cord 71, extending upwardly through an overflow tube 72 which is connected into and sealed with respect to an opening 73 in bottom wall 16. Cord 71 may lead to a junction box 74 into which a cord 75 from the blower motor 44 is connected and into which a plug and cord 76 for energizing pump motor 65 are connectable. A drain fitting 77 is also connected into bottom wall 16, at the lowermost portion of the concave recess formed by wall 16 and the layer of material 69, with fitting 77 being normally closed by a cap or plug 78, to allow complete draining by gravity through fitting 77 of all of the water contained in the device.

Make up water is supplied to the space within concave bottom wall 16 through a tube 88 leading upwardly through overflow tube 72 (FIG. 5), and connected to a valve 79 mounted by a bracket 80 and controlled by a float 81 and float actuated arm 82 to automatically maintain at all times the desired level of water in bottom wall 16. This automatically maintained level 67 is of course lower than the upper end of overflow tube 72, so that normally no water can enter the tube.

When the cooler is in use, blower 23 is maintained continuously in operation so long as a cooling effect is desired, to thus draw air inwardly through the porous pad 53 into chamber 27, and then from that chamber through blower inlet opening 32 into the interior of the blower. As moisture from pad 53 evaporates into the air, it substantially cools the air, which is ultimately discharged downwardly from the blower through opening 17 in bottom wall 16, and into duct 13 for delivery to the rooms or areas to be cooled. The pump 64 continuously recirculates water through pad 53 by pumping water from the lower portion of the circular assembly 10 to the tube 59 at the upper edge of the pad, which tube discharges the water into the pad at circularly spaced locations.

The cooler 10 may if desired be mounted at ground level as shown in FIG. 1, with the duct 13 extending beneath the floor of a building to discharge air upwardly into the rooms to be cooled. Alternatively, the cooler may be mounted on the roof 83 of a building, as seen in FIG. 10, with a horizontal mounting plate 11*a* corresponding to plate 11 of FIG. 1 being suitably secured to the roof, so that the duct 13*a* can extend through the attic space of the building and connect downwardly into the rooms to be cooled. In addition to this change, the variational cooler 10*a* of FIG. 10 is illustrated as having its circular evaporation pad 53*a* formed sectionally, of a number of arcuate partial cylindrical sections 153*a* meeting and appropriately secured together along a number of verticle circularly spaced lines 84, to form together a composite circular pad structure. Also, the arrangement of FIG. 10 may include cylindrical decorative air passing screen 85 extending about the pad 53*a*, parallel thereto and centered about the same axis 15a, Like the pad, this screen may be formed of arcuate sections secured together along circularly spaced vertical lines 86. The screen sections 85 may be stamped from sheet metal to form angularly diposed louvres 87, between which air can flow inwardly to the pad. The screen can be held in place by the top and bottom walls 14*a* and 16*a* in the same manner that the pad is retained.

It is contemplated that in some instances the air from my coolers may discharge laterally therefrom through an opening in the circular pad, or may discharge upwardly through the top wall of the device.

While certain embodiments of the present invention have been disclosed as typical, the invention is of course not limited to these particular forms, but rather is applicable broadly to all such variations as fall within the scope of the appended claims.

I claim:

1. An evaporative cooler comprising:

an evaporation pad structure curving essentially circularly and cylindrically about an essentially vertical axis and defining an essentially cylindrical chamber into which air flows through said pad structure from the outside thereof;

an upper wall extending across the top of said chamber;

an essentially circular lower wall extending inwardly from the lower edge of said pad structure and defining the bottom of said chamber and containing a central air discharge opening;

an essentially vertical air discharge conduit connected to said lower wall about said opening in fluid tight sealed relation and projecting upwardly from said bottom wall and containing a passage through which air discharges from said chamber;

a motor driven blower connected to said conduit at a location spaced above said bottom wall and supported by said conduit and acting to draw air into said chamber through said pad structure and then discharge said air and carried moisture from the pad structure downwardly through said air discharge conduit;

said lower wall in extending inwardly from said pad structure to said conduit being of essentially annular downwardly convex configuration to progressively advance downwardly as it advances inwardly toward said conduit, and forming a water accumulation sump extending about and closely adjacent said conduit but isolated from the air flowing within the conduit;

means for pumping water from said accumulation sump to an upper portion of said pad structure, and including a pump taking suction from said accumulation sump; and means at the upper side of said lower wall forming an upper surface on which water in said sump rests and which is lower at the location of the suction of said pump than at other locations spaced circularly therefrom.

2. An evaporative cooler as recited in claim 1, including a connection for detachably securing said top wall to said blower.

3. An evaporative cooler as recited in claim 1, including a cylindrical mounting projection connected to the underside of said lower wall at a location radially between said evaporation pad and said conduit and projecting downwardly from said bottom wall for securing said cooler to a support structure.

4. An evaporative cooler as recited in claim 3, including anchoring brackets for attaching said cylindrical mounting projection to a horizontal support surface.

5. An evaporative cooler comprising:

an evaporation pad structure curving essentially circularly and cylindrically about an essentially vertical axis and defining an essentially cylindrical chamber into which air flows through said pad structure from the outside thereof;

an upper wall extending across the top of said chamber;

an essentially circular lower wall extending inwardly from the lower edge of said pad structure and defining the bottom of said chamber and containing a central air discharge opening;

an essentially vertical air discharge conduit connected to said lower wall about said opening in fluid tight sealed relation and projecting upwardly from said bottom wall and containing a passage through which air discharges from said chamber;

a motor driven blower connected to said conduit at a location spaced above said bottom wall and supported by said conduit and acting to draw air into said chamber through said pad structure and then discharge said air and carried moisture from the pad structure downwardly through said air discharge conduit;

said lower wall in extending inwardly from said pad structure to said conduit being of essentially annular downwardly convex configuration to progressively advance downwardly as it advances inwardly toward said conduit, and forming a water accumulation sump extending about and closely adjacent said conduit but isolated from the air flowing within the conduit;

means for pumping water from said accumulation sump to an upper portion of said pad structure, and including a water pump taking suction from said accumulation sump, at a predetermined location; and material on the upper side of said lower wall forming a surface on which the water in said accumulation sump is received, said material being thicker at locations offset circularly from the suction of said pump than at that suction location itself.

6. An evaporative cooler comprising:

an evaporation pad structure curving essentially circularly and cylindrically about an essentially vertical axis and defining an essentially cylindrical chamber into which air flows through said pad structure from the outside thereof;

an upper wall extending across the top of said chamber;

an essentially circular lower wall extending inwardly from the lower edge of said pad structure and defining the bottom of said chamber and containing a central air discharge opening;

an essentially vertical air discharge conduit connected to said lower wall about said opening in fluid tight sealed relation and projecting upwardly from said bottom wall and containing a passage through which air discharges from said chamber;

a motor driven blower connected to said conduit at a location spaced above said bottom wall and supported by said conduit and acting to draw air into said chamber through said pad structure and then discharge said air and carried moisture from the pad structure downwardly through said air discharge conduit;

said lower wall in extending inwardly from said pad structure to said conduit being of essentially annular downwardly convex configuration to progressively advance downwardly as it advances inwardly toward said conduit, and forming a water accumulation sump extending about and closely adjacent said conduit but isolated from the air flowing within the conduit;

means for pumping water from said accumulation sump to an upper portion of said pad structure;

said top wall being circular of annular upwardly convexly curving configuration;

a post projecting upwardly from said blower and extending through a central opening in said top wall and having a fastener for detachably retaining said top wall;

a layer of material on the upper surface of said lower wall on which water in said sump is received and which is thicker at one location than at a diametrically opposite location with respect to said axis to present an upper surface which slopes progressively downwardly toward said diametrically opposite location;

said pumping means including a pump taking suction at said diametrically opposite location; and a mounting cylinder projecting downwardly from the underside of said circular bottom wall at a location radially between said evaporation pad and said conduit and connectible to a supporting surface to secure the cooler thereto.

* * * * *